US009725866B1

(12) United States Patent
Fjotland

(10) Patent No.: US 9,725,866 B1
(45) Date of Patent: Aug. 8, 2017

(54) TIEBACK ASSEMBLY WITH REMOVABLE TENDON THREADED ELEMENT

(71) Applicant: MORETRENCH AMERICAN CORPORATION, Rockaway, NJ (US)

(72) Inventor: Wayne Fjotland, Ramsey, NJ (US)

(73) Assignee: Moretrench American Corporation, Rockaway, NJ (US)

( * ) Notice: Subject to any disclaimer, the term of this patent is extended or adjusted under 35 U.S.C. 154(b) by 0 days.

(21) Appl. No.: 15/347,273

(22) Filed: Nov. 9, 2016

(51) Int. Cl.
*E02D 5/80* (2006.01)
*E02D 5/76* (2006.01)

(52) U.S. Cl.
CPC ..... *E02D 5/801* (2013.01); *E02D 5/765* (2013.01); *E02D 2220/00* (2013.01); *E02D 2250/003* (2013.01); *E02D 2250/0046* (2013.01); *E02D 2300/0006* (2013.01); *E02D 2300/0026* (2013.01)

(58) Field of Classification Search
CPC .. E02D 5/74; E02D 5/76; E02D 5/765; E02D 5/80
USPC ..... 405/262
See application file for complete search history.

(56) References Cited

U.S. PATENT DOCUMENTS 4,124,983 A * 11/1978 Weatherby ..... E02D 5/76 174/DIG. 8
4,718,791 A * 1/1988 Weatherby ..... E02D 5/74 405/262
4,850,746 A * 7/1989 Finsterwalder ..... E21D 21/0033 405/259.5
7,967,532 B2 6/2011 Schmidt et al.
9,267,287 B1 2/2016 Bongiorno
2008/0193225 A1* 8/2008 Melegari ..... E02D 5/76 405/275
2009/0151302 A1* 6/2009 Benford ..... E02D 5/803 52/846

FOREIGN PATENT DOCUMENTS

DE 29521197 U1 * 10/1996 ..... E02D 5/80
WO 2014037113 A1 3/2014

OTHER PUBLICATIONS

Deep Excavations; Support Systems for Deep Excavation: Tie-backs/Rock Anchors; http://www.deepexcavation.com/en/anchored-walls-tiebacks-anchors; printed Jul. 27, 2016.

(Continued)

*Primary Examiner* — Benjamin Fiorello

(57) ABSTRACT

In one aspect, a tieback assembly is provided herein for supporting a SOE, the tieback assembly including: at least one anchor; an anchor threaded element extending from an end of the anchor; a tendon for transmitting force between the anchor and the SOE, the tendon including at least one tendon threaded element; and, a coupler having a body with a threaded bore, the tendon threaded element and the anchor threaded element threadedly engaging the threaded bore. Furthermore, the tendon is provided with sufficient length to extend at least from the coupler to externally of the SOE so that a portion of the tendon may be engaged externally of the SOE to allow for disengagement of the tendon threaded element from the coupler. Advantageously, the subject invention allows for at least partial removal of the tendon from a tieback assembly, including removal of the tendon threaded element.

25 Claims, 3 Drawing Sheets

(56) References Cited

OTHER PUBLICATIONS

DYWIDAG-Systems International; DYWIDAG Threadbar Reinforcing Systems; brochure; May 2000.
DYWIDAG-Systems International; DYWIDAG Removable Anchor Systems; brochure; Jan. 2016.

* cited by examiner

TIEBACK ASSEMBLY WITH REMOVABLE TENDON THREADED ELEMENT

BACKGROUND OF THE INVENTION

Deep excavations often require a support of excavation system (SOE) which acts as a retaining wall or similar structure against adjacent earth. The SOE may be a temporary or permanent installation.

Tieback assemblies are commonly used to retain the SOE in resisting lateral loads resulting from adjacent earth pressure. Tieback assemblies are introduced through the SOE into the adjacent earth with an anchor at the leading end and a tendon extending therefrom. The tendon extends externally of the SOE to be fixed thereagainst, either directly or through a secondary structure, such as a wale. The anchor is formed to engage surrounding earth or a cementitious grout which is deposited about the anchor. In any case, the anchor, interacting with surrounding earth directly or through deposited grout, provides a resistive force against removal of the tieback assembly through the SOE. With the fixation of the tendon against the SOE, force is transmitted between the SOE and the anchor counteracting the earth-generated lateral forces.

In typical installations, tieback assemblies extend into adjacent tracts of land having different ownership from the related excavation or work site. In addition, tieback assemblies are typically left in the ground after the completion of work. Because of the encroachment onto neighboring properties, an increasing number of government regulations and private landowners are requiring at least partial removal of tieback assemblies. As a result, easement fees, contractual penalties, and the like, are being assessed on tieback assemblies which remain fully intact in the ground after completion of the related job.

SUMMARY OF THE INVENTION

In one aspect, a tieback assembly is provided herein for supporting a SOE against adjacent earth, the tieback assembly including: at least one anchor for being located in the adjacent earth spaced from the SOE; an anchor threaded element extending from an end of the anchor; a tendon for transmitting force between the anchor and the SOE, the tendon including at least one tendon threaded element; and, a coupler having a body with a threaded bore extending between first and second ends of the body, the tendon threaded element threadably engaging the threaded bore through the first end of the body and the anchor threaded element threadedly engaging the threaded bore through the second end of the body. Furthermore, the tendon is provided with sufficient length to extend at least from the coupler to externally of the SOE so that a portion of the tendon may be engaged externally of the SOE to allow for disengagement of the tendon threaded element from the coupler. Advantageously, the subject invention allows for at least partial removal of the tendon from a tieback assembly, including removal of the tendon threaded element.

In a further aspect, a tieback assembly is provided for supporting a SOE against adjacent earth, the tieback assembly including: at least one anchor for being located in the adjacent earth spaced from the SOE, the anchor having a threaded bore formed therein extending from one end thereof; and, a tendon for transmitting force between the anchor and the SOE, the tendon including at least one tendon threaded element, the tendon threaded element threadedly engaging the threaded bore. Furthermore, the tendon is provided with sufficient length to extend at least from the anchor to externally of the SOE so that a portion of the tendon may be engaged externally of the SOE to allow for disengagement of the tendon threaded element from the anchor. Advantageously, the subject invention allows for at least partial removal of the tendon from a tieback assembly, including removal of the tendon threaded element.

As used herein, a "support of excavation system" or "SOE" can be any retaining wall, piling, etc. which is utilized to retain earth, particularly from entering a site intended to be separated from adjacent earth, such as an excavation site, a work site, etc.; examples of SOE's may include retaining walls, sheet pile walls, cofferdams, soldier pile and lagging walls, slurry walls, secant pile walls, and, cement-bentonite soldier pile walls. The SOE's may be temporary or permanent.

These and other features of the subject invention will be better understood through a study of the follow detailed description and accompanying drawings.

DETAILED DESCRIPTION OF THE INVENTION

Figure 1:
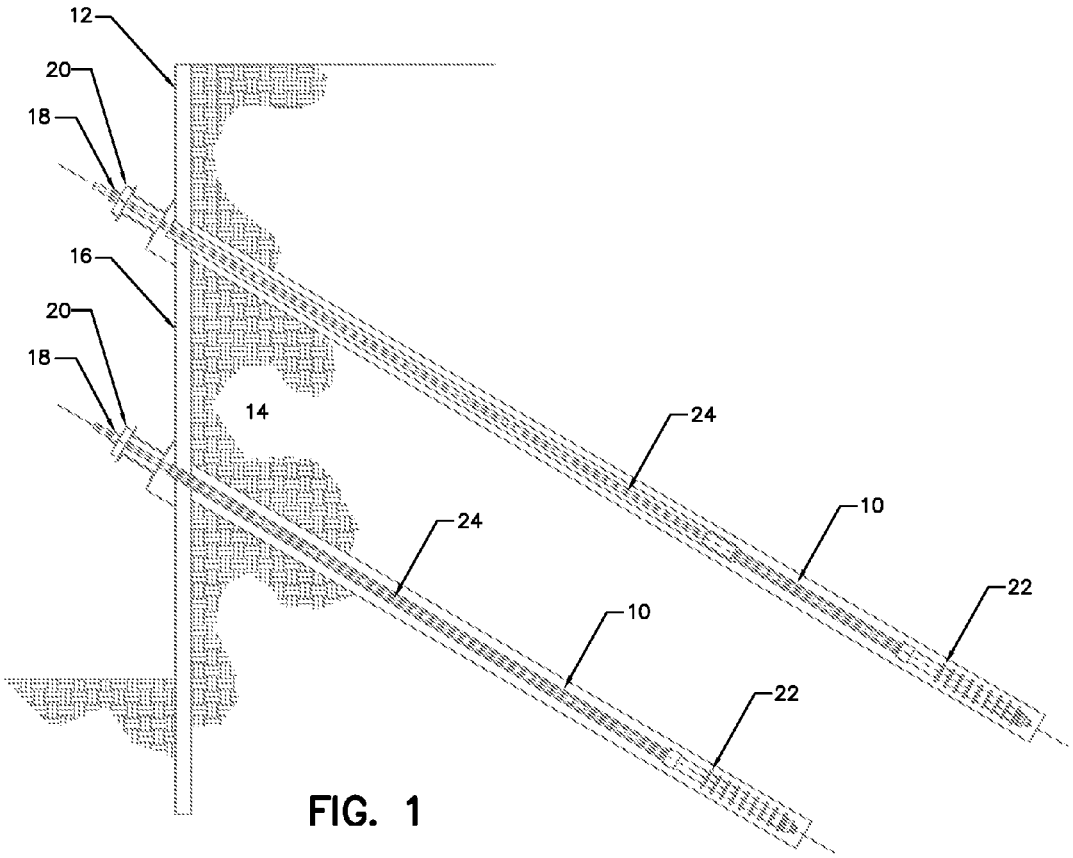
FIG. 1 is a schematic of a SOE being supported by installed tiebacks.

With reference to FIG. 1, a tieback assembly 10 is shown useable for supporting SOE 12 in resisting lateral loads generated by earth 14 adjacent to the SOE 12. The tieback assembly 10 is secured to an external face 16 of the SOE 12, directly or through a secondary structure (e.g., a wale), using any technique. For example, a tensioning nut 18 may be secured to the tieback assembly 10 with a bearing plate 20 situated to distribute force from the tensioning nut 18 across an area of the SOE 12 or the secondary structure. Two or more of the tieback assemblies 10 may be secured to a common secondary structure, such as a wale.

Figure 2:
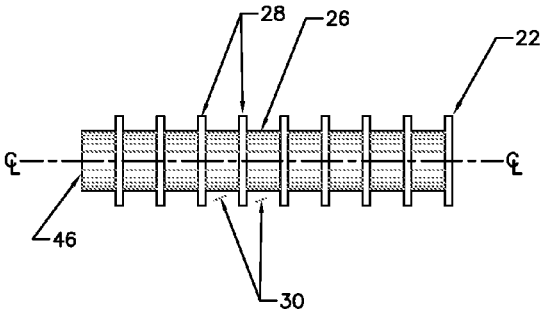
FIG. 2 shows an anchor useable with the subject invention.

The tieback assembly 10 generally includes at least one anchor 22 and a tendon 24 for transmitting force between the anchor 22 and the SOE 12. The anchor 22 may be formed of various materials, including plastic and/or metal. Preferably, as shown in FIG. 2, the anchor 22 has an elongated shape which extends along a central longitudinal axis CL which is generally coincident with a longitudinal axis of the tieback assembly 10. The anchor 22 may be provided along its outer surface 26 with one or more protrusions 28 which define recesses 30 for engagingly receiving earth or grout. The protrusions 28 may be annular (e.g., flange shaped) or extend across a limited circumference of the outer surface 26 of the anchor 22. The protrusions 28 may be joined so as form continuous or semi-continuous structures, including a helical wall. The recesses 30 may be spaced along the central longitudinal axis CL so that earth or grout may be received in successive layers or partial layers about the anchor 22 along the longitudinal direction. This arrangement provides resistive force against movement of the anchor 22 in a direction along the central longitudinal axis CL towards the SOE 12, thereby generating an anchoring force.

The anchor 22 may be a unitary piece, e.g., being formed by casting, or a modular, assembled structure. By way of non-limiting example, the anchor 22 may be formed by multiple assembled pieces, such as, alternating collars 29 and plates 31 to define the protrusions 28 and the recesses 30. In addition, the protrusions 28 may be provided as separate components and affixed to the outer surface 26 using any technique, such as welding, adhering, friction fit, interference fit, etc. The protrusions 28 may be located at one or both of the ends of the anchor 22 (FIG. 3) or spaced inwardly from one or both of the ends (FIG. 2).

The tendon 24 includes at least one tendon threaded element 32. Preferably, the tendon threaded element 32 is formed of metal, such as prestressed metal, e.g., prestressed steel.

Figure 3:
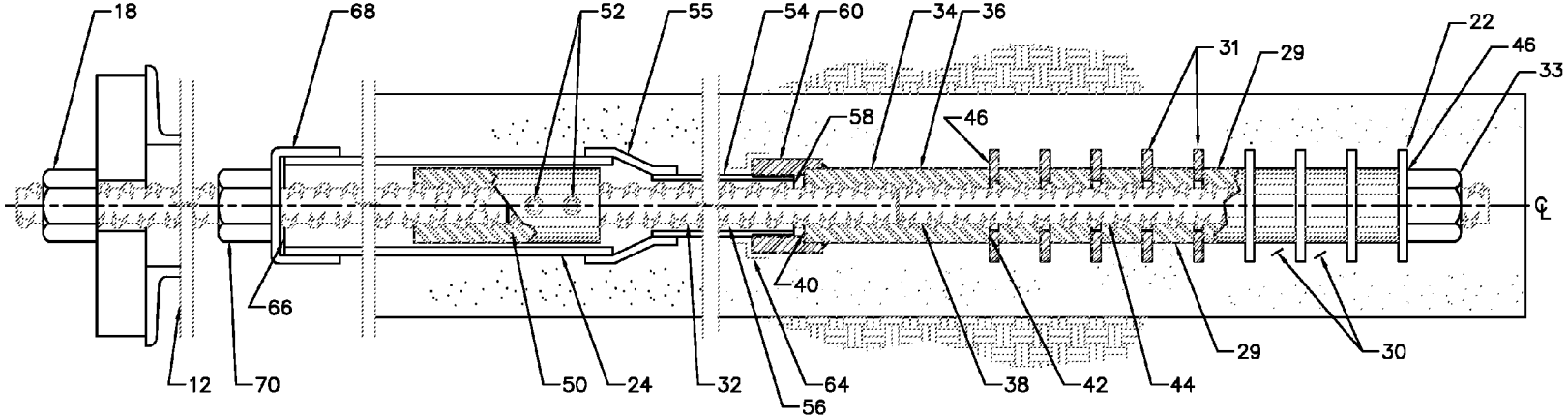
FIG. 3 is a side view of a tieback assembly formed in accordance with a first embodiment of the subject invention.

With the subject invention, at least a portion of the tendon 24 is removable from the tieback assembly 10, particularly after the tieback assembly 10 is no longer needed or primarily relied upon for support of the SOE 12. In a first embodiment, as shown in FIG. 3, a coupler 34 is provided having a body 36 with a threaded bore 38 extending between first and second ends 40, 42 of the body 36. The tendon threaded element 32 threadably engages the threaded bore 38 through the first end 40. In addition, an anchor threaded element 44 extends from an end 46 of the anchor 22 which threadably engages the threaded bore 38 through the second end 42. The anchor threaded element 44 may be formed as a protruding threaded post or mounted into a bore in the anchor 22 (such as a threaded bore). Additionally, the anchor threaded element 44 may act as a joining piece for the anchor 22, for example, to hold together multiple pieces (e.g., collars 29 and plates 31) where the anchor 22 is of a modular construction. A fixation nut 33 threadedly engaging the anchor threaded element 44, or other element, may be used as needed to provide holding force for the assembled modular construction. The anchor threaded element 44 may extend completely through the anchor 22 so as to extend from both ends thereof.

The tendon 24 is provided with sufficient length to extend from the coupler 34 to externally of the SOE 12. In this manner, a portion of the tendon 24 may be engaged externally of the SOE 12, particularly to allow for disengagement of the tendon threaded element 32 from the coupler 34. In one variation, the tendon threaded element 32 is provided with sufficient length to extend from the coupler 34 to externally of the SOE 12 so that torque applied to the exposed portion of the tendon threaded element 32 results in rotation of the tendon threaded element 32, including in a rotational direction to permit threaded disengagement of the tendon threaded element 32 from the threaded bore 38. Once disengaged, the tendon threaded element 32 may be withdrawn through the SOE 12, leaving the anchor 22 in the earth 14. The tensioning nut 18 may directly threadedly engage the tendon threaded element 32.

Figure 4:
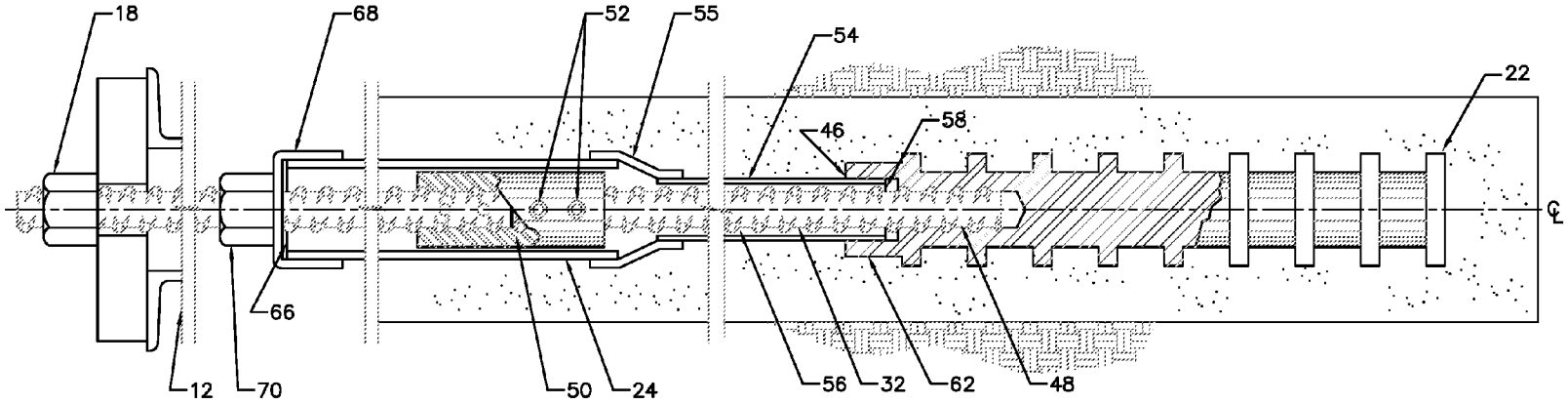
FIG. 4 is a side view of a tieback assembly formed in accordance with a second embodiment of the subject invention.

In a second embodiment, as shown in FIG. 4, the anchor 22 is formed with a threaded bore 48. The tendon threaded element 32 threadably engages the threaded bore 48 through the end 46. The tendon 24 is provided with sufficient length to extend from the anchor 22 to externally of the SOE 12 so that a portion of the tendon 24 may be engaged externally of the SOE 12, particularly to allow for disengagement of the tendon threaded element 32 from the anchor 22. In one variation, the tendon threaded element 32 is provided with sufficient length to extend from the anchor 22 to externally of the SOE 12 so that torque applied to the exposed portion of the tendon threaded element 32 results in rotation of the tendon threaded element 32, including in a rotational direction to permit threaded disengagement of the tendon threaded element 32 from the threaded bore 48. Once disengaged, the tendon threaded element 32 may be withdrawn through the SOE 12, leaving the anchor 22 in the earth 14. The tensioning nut 18 may directly threadedly engage the tendon threaded element 32.

Interengagement between the anchor 22 and surrounding earth 14 and/or grout is expected to provide a holding force resisting rotational movement of the anchor 22, including with removal torque being applied to the tendon threaded element 32.

The tendon threaded element 32 may be a single length of rod or of multiple lengths of rod coupled together in end-to-end fashion. A multiple-length arrangement is preferred with the distance between the SOE 12 and the anchor 22 being relatively great, e.g., greater than forty feet. Intermediate couplings 50 may be used as needed to join the various lengths of the tendon threaded element 32. The couplings 50 may of any known type, including being collar shaped, with threaded bore, and optional set screws 52 for additional holding force. Extraction of the tendon threaded element 32 is preferably intended to include extraction of all lengths of rod contained therein.

The threading referenced herein may be of any configuration. The tendon threaded element 32 and the anchor threaded element 44 may be rod shaped, but not necessarily with circular cross-sections. Rods with flattened sides may be used with partial threads being provided as ridges along edges thereof. This configuration is known in the prior art and commonly referred to as "threadbar." The threaded bore 38 and the threaded bore 48 are configured with threading formed to complementarily receive the threads of the tendon threaded element 32 and/or the anchor threaded element 44, as the case may be. The tensioning nut 18, collars 29, fixation nut 33 and the couplings 50 may be similarly formed. Threaded connections may be coated with compound to provide lubricity as needed.

The tendon 24 may be provided with an outer sheath 54 extending along at least a portion of the tendon threaded element 32. The outer sheath 54 may be a single tubular member or a plurality of joined tubular members, including of various diameters. The outer sheath 54 may include transitions 55 to accommodate changes in diameter.

Grease 56, or other lubricious material, may be contained within the outer sheath 54 about at least a portion of the tendon threaded element 32. The grease 56 may be corrosion resistant. The grease 56 assists in the tensioning of, during installation, and later removal of the tendon threaded element 32. The outer sheath 54, at a distal end 58, may be received in a coupler 60 or a coupler portion 62 of the anchor 22, as the case may be. The coupler 60 may be affixed to the coupler 34 so as to not be rotatable relative thereto, such as by welding, adhesion, taping, etc. The outer sheath 54 may be threadably received within the coupler 60 or the coupler portion 62 so as to have rotational movement therebetween restricted. With this arrangement, rotation of the outer sheath 54 relative to the anchor 22 and the coupler 34, as the case may be, is limited. Preferably, the thread arrangement between the outer sheath 54 and the coupler 60 or the coupler portion 62 is opposite to that of the tendon threaded element 32 so that rotation to allow for disengagement of the tendon threaded element 32 does not result in disengagement of the outer sheath 54 from the coupler 60 or the coupler portion 62.

Tape 64 or other sealing may be utilized to cover any possible open seams or other joints between the outer sheath 54 and the coupler 60 or the coupler portion 62. A proximal end 66 of the outer sheath 54 may be capped such as with end cap 68. The end cap 68 may be secured using any known technique. A locking nut 70 may be utilized which is threaded onto the tendon threaded element 32 into pressing engagement against the end cap 68 to provide a holding force. Any utilized intermediate couplings 50 may be contained within the outer sheath 54. The locking nut 70 may be formed with threading similar to that described above of the tendon threaded element 32 and/or the anchor threaded element 44.

Figure 5A:
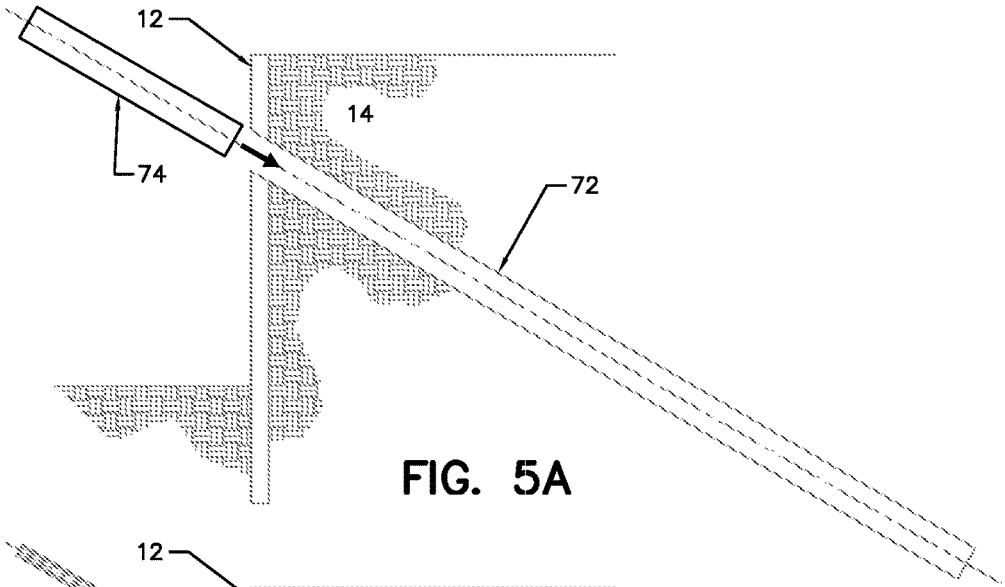
FIGS. 5A-5B show an installation of a tieback assembly in accordance with the subject invention.
Figure 5B:
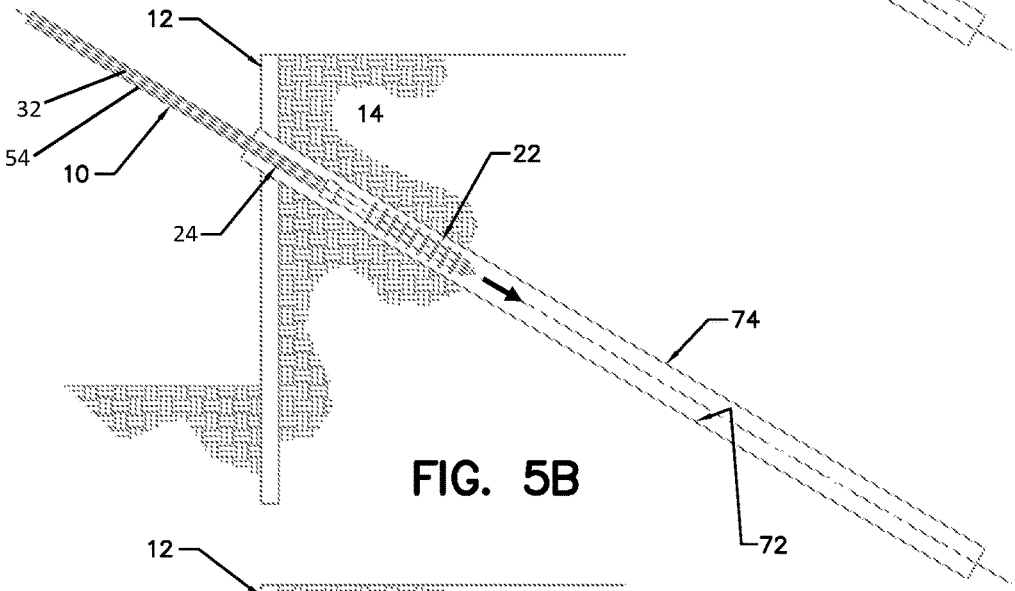

For installation, a bore 72 is formed through the SOE 12 and the earth 14 along a determined axis, typically at a non-perpendicular angle relative to the SOE 12. As shown in FIG. 5A, a casing 74 is introduced into the bore 72 having an inner diameter in excess of the outer diameter of the anchor 22. The anchor 22 is prepared, e.g., assembled as needed. Cementitious grout may be introduced into the casing 74, when in the bore 72, if the tieback assembly 10 is intended to be grouted. If grouted, sufficient grout is introduced into the casing 74, utilizing known techniques, such as utilizing a tremie tube. Once sufficient grout is introduced, or if no grout is utilized, the tieback assembly 10, including having the anchor 22 affixed to the tendon threaded element 32 either directly or through the coupler 34, is inserted through the casing 74 to a target installation depth (FIG. 5B). The casing 74 is afterwards removed. Prior to removal of the casing 74, additional grout may be introduced as needed, for example with a regrouting tube, particularly after the tieback assembly 10 has been inserted into the casing 74. The regrouting may occur after allowing for at least partial curing of the originally introduced grout. Regrouting may allow for more thorough coverage by the grout. The tieback assembly 10 is secured to the SOE 12 and tension may be introduced across the tendon 24 using known techniques, such as applying torque to the tensioning nut 18 at the exposed portion of the tendon threaded element 32.

Figure 6:
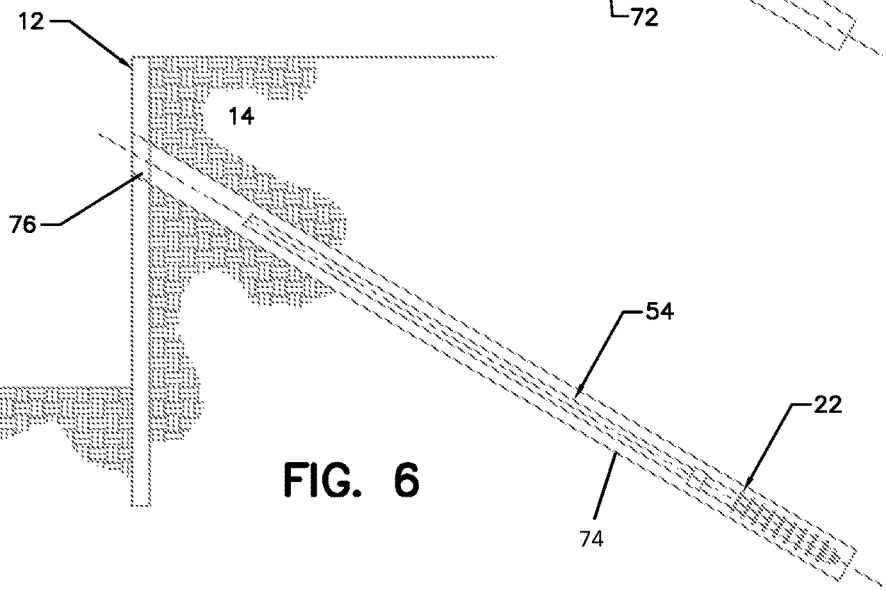
FIG. 6 shows an installation after removal of a tendon threaded element.

With a job completed and/or with primary reliance on the tieback assembly 10 for support of the SOE 12 completed, the tendon threaded element 32 may be removed as discussed above. The tensioning nut 18 or other securing elements at the SOE 12 may be removed to facilitate removal of the tendon threaded element 32 optionally with the bore 72 being sealed with patch 76. It is noted that portions of the tieback assembly 10 may remain in the earth 14 such as the anchor 22 and the outer sheath 54, as shown in FIG. 6. Removal of these elements is considered less significant once the tendon threaded element 32 has been removed. The removal of the tendon threaded element 32 may be considered tantamount to the removal of the tieback assembly 10. Significantly, any subsequent excavation in the vicinity of the tieback assembly 10 can easily displace the remaining components (anchor, outer sheath, etc.) of the tieback assembly 10 where there has been removal of the tendon threaded element 32.

What is claimed is:

1. A tieback assembly for supporting a SOE against adjacent earth, the tieback assembly comprising:

at least one anchor for being located in the adjacent earth spaced from the SOE;

an anchor threaded element extending from an end of said anchor;

a tendon for transmitting force between said anchor and the SOE, said tendon including at least one tendon threaded element; and, a coupler having a body with a threaded bore extending between first and second ends of said body, said tendon threaded element threadably engaging said threaded bore through said first end of said body and said anchor threaded element threadedly engaging said threaded bore through said second end of said body, wherein, said tendon has sufficient length to extend at least from said coupler to externally of the SOE so that a portion of said tendon may be engaged externally of the SOE to allow for disengagement of said tendon threaded element from said coupler.

2. A tieback assembly as in claim 1, wherein said anchor includes one or more protrusions which define recesses for engagingly receiving earth or cementitious grout.

3. A tieback assembly as in claim 2, wherein said anchor has an elongated shape which extends along a central longitudinal axis, and, wherein, said recesses are spaced along said central longitudinal axis.

4. A tieback assembly as in claim 1, wherein said anchor is of unitary construction.

5. A tieback assembly as in claim 1, wherein said anchor is formed of alternating collars and plates.

6. A tieback assembly as in claim 1, wherein said anchor includes a generally cylindrical body with an outer surface, and a plurality of protrusions affixed to said outer surface.

7. A tieback assembly as in claim 1, wherein said tendon threaded element is formed of metal.

8. A tieback assembly as in claim 7, wherein said metal is prestressed metal.

9. A tieback assembly as in claim 1, wherein said anchor threaded element extends through said anchor so as to extend from both ends thereof.

10. A tieback assembly as in claim 9, further comprising a fixation nut threadedly engaging the anchor threaded element.

11. A tieback assembly as in claim 1, wherein said tendon threaded element includes at least one length of rod.

12. A tieback assembly as in claim 11, wherein said tendon further comprising at least one intermediate coupling to join two lengths of rod of said tendon threaded element.

13. A tieback assembly as in claim 1, wherein said tendon further comprising an outer sheath extending along at least a portion of said tendon threaded element.

14. A tieback assembly as in claim 13, wherein said tendon further comprising grease contained within said outer sheath about at least a portion of the tendon threaded element.

15. A tieback assembly for supporting a SOE against adjacent earth, the tieback assembly comprising:

at least one anchor for being located in the adjacent earth spaced from the SOE, said anchor having a threaded bore formed therein extending from one end thereof; and, a tendon for transmitting force between said anchor and the SOE, said tendon including at least one tendon threaded element, said tendon threaded element threadedly engaging said threaded bore, wherein, said tendon has sufficient length to extend at least from said anchor to externally of the SOE so that a portion of said tendon may be engaged externally of the SOE to allow for disengagement of said tendon threaded element from said anchor.

16. A tieback assembly as in claim 15, wherein said anchor includes one or more protrusions which define recesses for engagingly receiving earth or cementitious grout.

17. A tieback assembly as in claim 16, wherein said anchor has an elongated shape which extends along a central longitudinal axis, and, wherein, said recesses are spaced along said central longitudinal axis.

18. A tieback assembly as in claim 15, wherein said anchor is of unitary construction.

19. A tieback assembly as in claim 15, wherein said anchor includes a generally cylindrical body with an outer surface, and a plurality of protrusions affixed to said outer surface.

20. A tieback assembly as in claim 15, wherein said tendon threaded element is formed of metal.

21. A tieback assembly as in claim 20, wherein said metal is prestressed metal.

22. A tieback assembly as in claim 15, wherein said tendon threaded element includes at least one length of rod.

23. A tieback assembly as in claim 22, wherein said tendon further comprising at least one intermediate coupling to join two lengths of rod of said tendon threaded element.

24. A tieback assembly as in claim 15, wherein said tendon further comprising an outer sheath extending along at least a portion of said tendon threaded element.

25. A tieback assembly as in claim 24, wherein said tendon further comprising grease contained within said outer sheath about at least a portion of the tendon threaded element.

* * * * *